United States Patent [19]

Kinion

[11] Patent Number: 4,607,519

[45] Date of Patent: Aug. 26, 1986

[54] VEHICLE WHEEL ALIGNMENT DEVICE

[76] Inventor: Stephen R. Kinion, 404 Burlington Dr., Colorado Springs, Colo. 80906

[21] Appl. No.: 614,525

[22] Filed: May 29, 1984

[51] Int. Cl.[4] ..... B21D 1/12

[52] U.S. Cl. ..... 72/457; 72/704

[58] Field of Search ..... 72/457, 704, 705; 280/661

[56] References Cited

U.S. PATENT DOCUMENTS

| | | | |
|---|---|---|---|
| 3,257,838 | 6/1966 | Spears | 72/705 |
| 3,754,427 | 8/1973 | Hunnicutt et al. | 72/705 |
| 4,103,531 | 8/1978 | Daniel | 72/704 |
| 4,424,697 | 1/1984 | Carver | 72/704 |

*Primary Examiner*—Lowell A. Larson

*Attorney, Agent, or Firm*—Richard W. Hanes

[57] ABSTRACT

A wheel alignment device for independently suspended wheels of a motor vehicle which comprises two mutually parallel tracks with interconnecting structure upon which are mounted traveling journals which receive and support the bi-laterally projecting spindles of an upstanding wheel attachment plate. A jack is provided to bear against the plate and the parallel track structure to selectively force the plate to pivot about the axis formed by the projecting spindles or about a vertical axis of the wheel plate in order to bring the wheel back to normal from a position of excessive toe in or toe out or positive or negative camber.

7 Claims, 8 Drawing Figures

Fig. 2
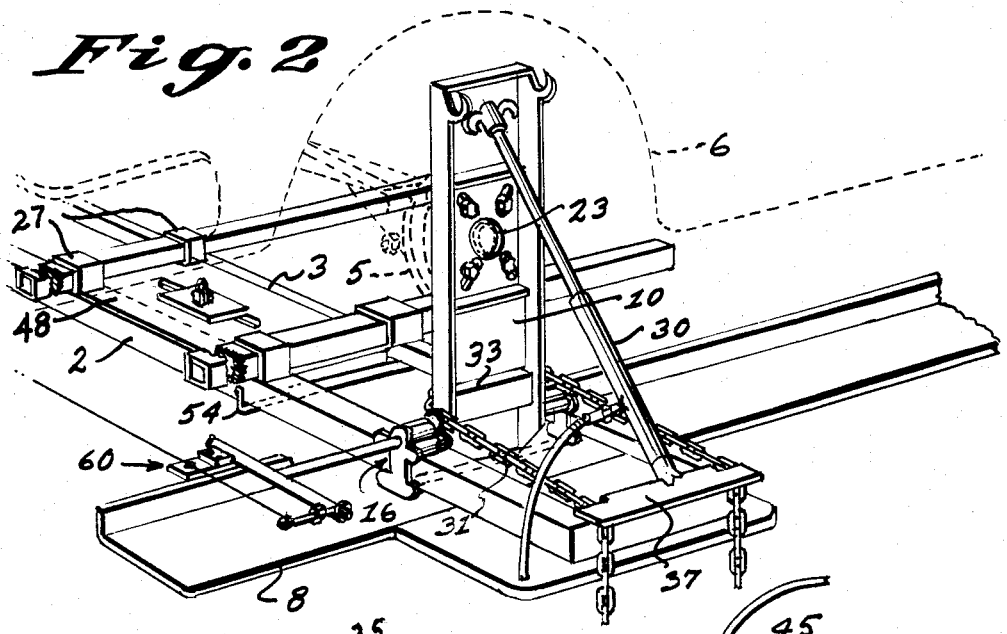
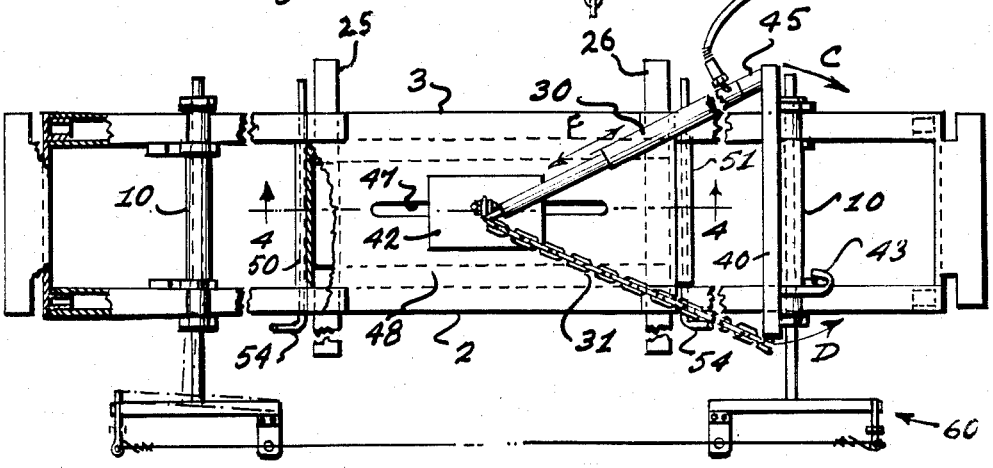
Fig. 3
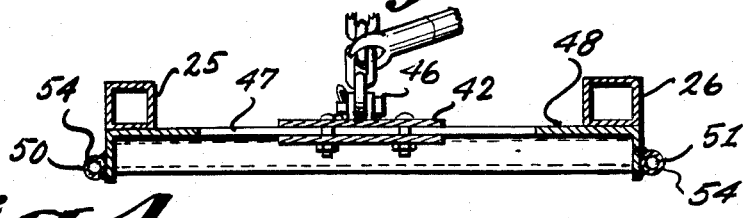
Fig. 4
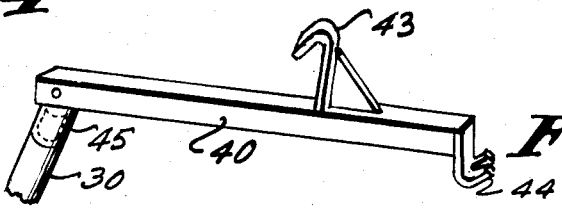
Fig. 5

VEHICLE WHEEL ALIGNMENT DEVICE

BACKGROUND OF THE INVENTION

The primary object of the present invention is to provide a straightening device for properly aligning independently suspended front or rear wheels of a vehicle where the suspension system has been bent so that the plane of the wheels is unduly toed in or toed out or cambered away from a normal vertical line.

A second object of the invention is to provide such a device which may be easily assembled and disassembled and used in connection with standard vehicle lift racks.

These and other objects of the invention will be apparent upon a reading of the following detailed description of the invention taken in conjunction with the accompanying drawings in which:

FIG. 2 is a prospective view of the mutually parallel tracks and the upstanding wheel attachment plate for the vehicle wheel alignment device with a portion of the vehicle shown in dashed lines. Portions of the structure are broken away and shown in cross section.

FIG. 3 is a top view of the alignment device with portions broken away and shown in cross section. The jack is shown positioned for rotating the attachment plate about its own vertical axis to correct a toe in problem with the right wheels of the vehicle.

FIG. 4 is a cross sectional view taken along lines 4—4 in FIG. 3.

FIG. 5 is a prospective view of the wheel attachment plate bracket with a portion of the jack fragmentarily shown.

DETAILED DESCRIPTION OF THE INVENTION

Figure 1:
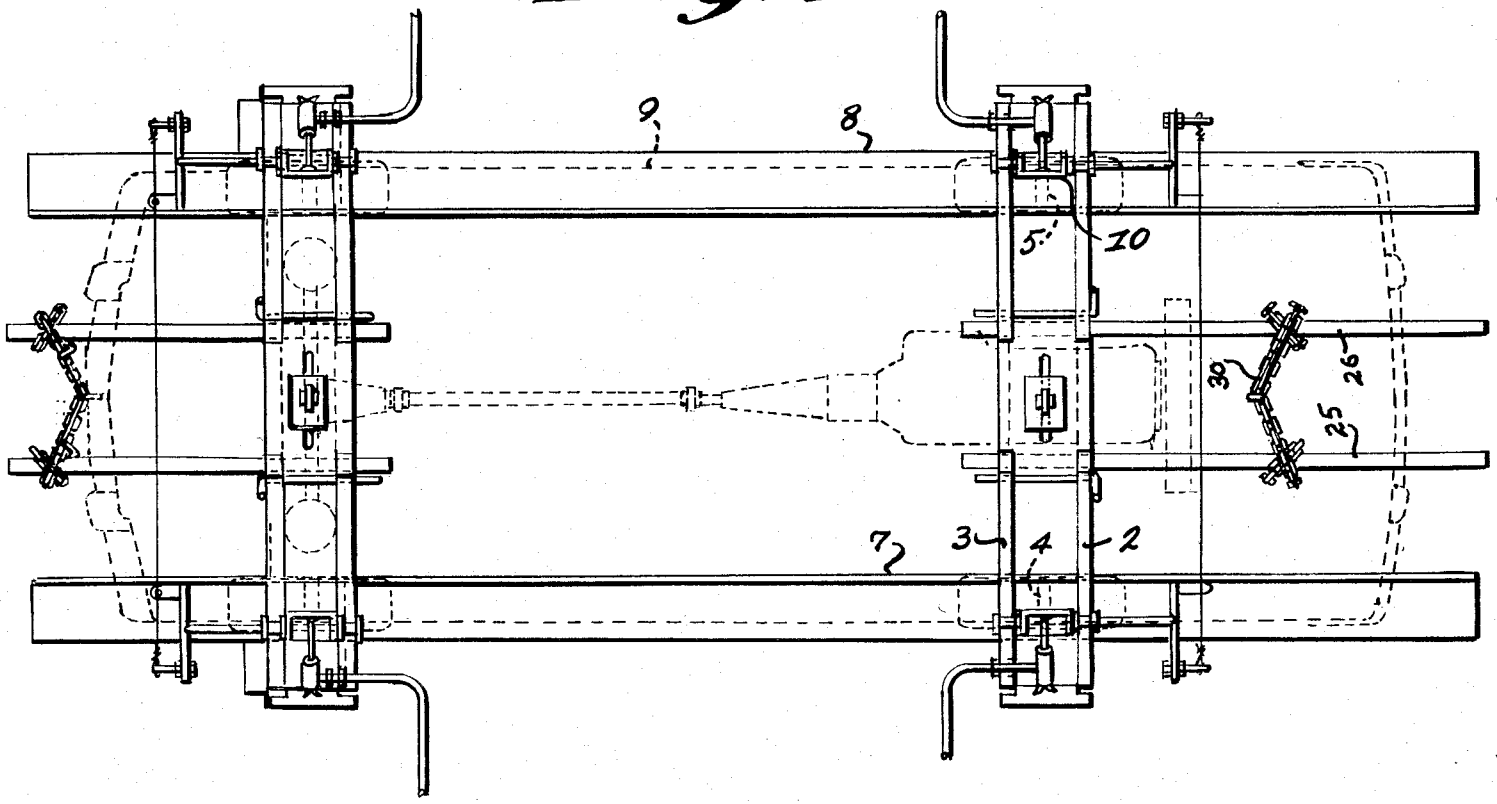
FIG. 1 is a top view of the wheel alignment device of the present invention positioned for alignment of either the front or rear wheels of a vehicle, which is shown in top view and outlined by the dashed lines. The parallel rails of a vehicle lift rack are shown but form no part of the invention.

A supporting frame is comprised of a pair of parallel rigid tubular track members 2 and 3 which are adapted to be positioned under the rear wheels 4 and 5 of the vehicle 6, generally to be supported by the rails 7 and 8 of a lift rack. Mounted on the tubular members 2 and 3 is a flanged wheel plate (the "plate") 10 which has bilaterally projecting spindles 11 and 12 at the lower extremity of the plate which are adapted to be journaled in cylindrical tubes 13 and 14 secured between the face plates 15 of roller brackets 16 and 17. Each of the roller brackets is sized to fit over the respective tubes 2 and 3 between upper and lower spaced apart roller pairs 19 and 20 disposed between the face plates of each of the brackets. The spacing and dimensions of the roller pairs are such as to allow free movement of each bracket along the length of the respective supporting tubes. The length of the bracket roller pairs and the consequent spacing between the bracket face plates 15 is sufficient to allow for play or slop between the bracket and its supporting tube in order that there be a limited ability for the bracket to rotate around a vertical axis. Thus, with this structure in mind it is seen that the plate 10 is capable of rotation about the axis formed by its horizontal spindles 11 and 12, as shown by arrows A and B in FIGS. 7 and 8 and to rotate about a vertical axis, as shown by arrows C and D in FIG. 3.

Centrally located on the face of the plate 10 are apertures 21 to accommodate the lug bolts on the vehicle wheel and a larger central aperture 22 to receive the hub 23 of the vehicle wheel. Before utilizing the device to obtain proper wheel alignment the wheel is attached to the plate 10 by the use of the lug bolts and nuts, as shown in FIGS. 2, 7 and 8.

Figure 7:
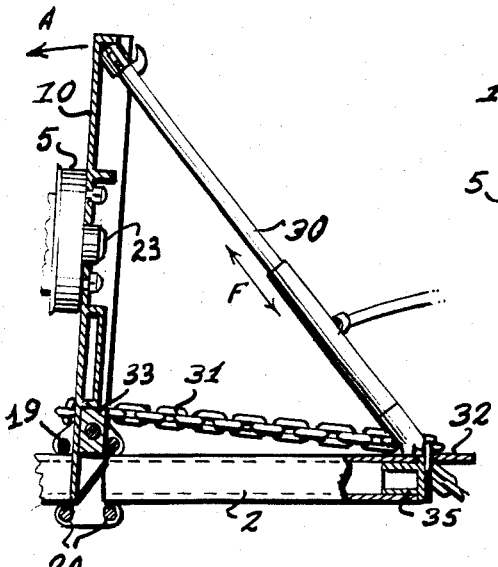
FIG. 7 is a fragmentary cross sectional view of the wheel alignment device with the jack selectively positioned as in FIG. 2, to correct a condition of positive camber in the wheel.
Figure 8:
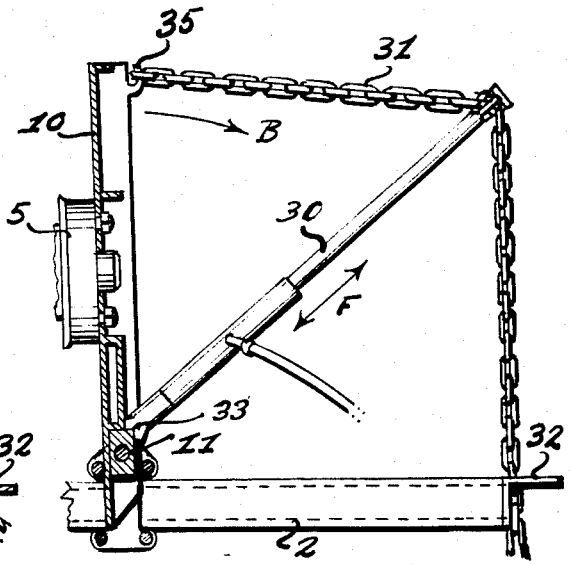
FIG. 8 is a fragmentary cross sectional view of the wheel alignment device with the jack selectively positioned to correct a condition of negative camber in the wheel.

When straightening an improperly cambered wheel, as shown in FIGS. 7 and 8, it is desirable to stabilize the frame members 2 and 3 with respect to the vehicle frame. A pair of spaced apart tubular stabilizing arms 25 and 26 are inserted through the apertures formed by four rectangular straps 27 rigidly attached to a plate 48 attached to the tube members 2 and 3, forming a rigid structural rectangle centrally of the tubes 2 and 3. A chain 28 is wrapped around the stabilizing arms 25 and 26, as shown in FIG. 1 and attached to a part of the vehicle frame, preventing movement of the tubular frame members 2 and 3 in the direction of their length.

Figure 6:
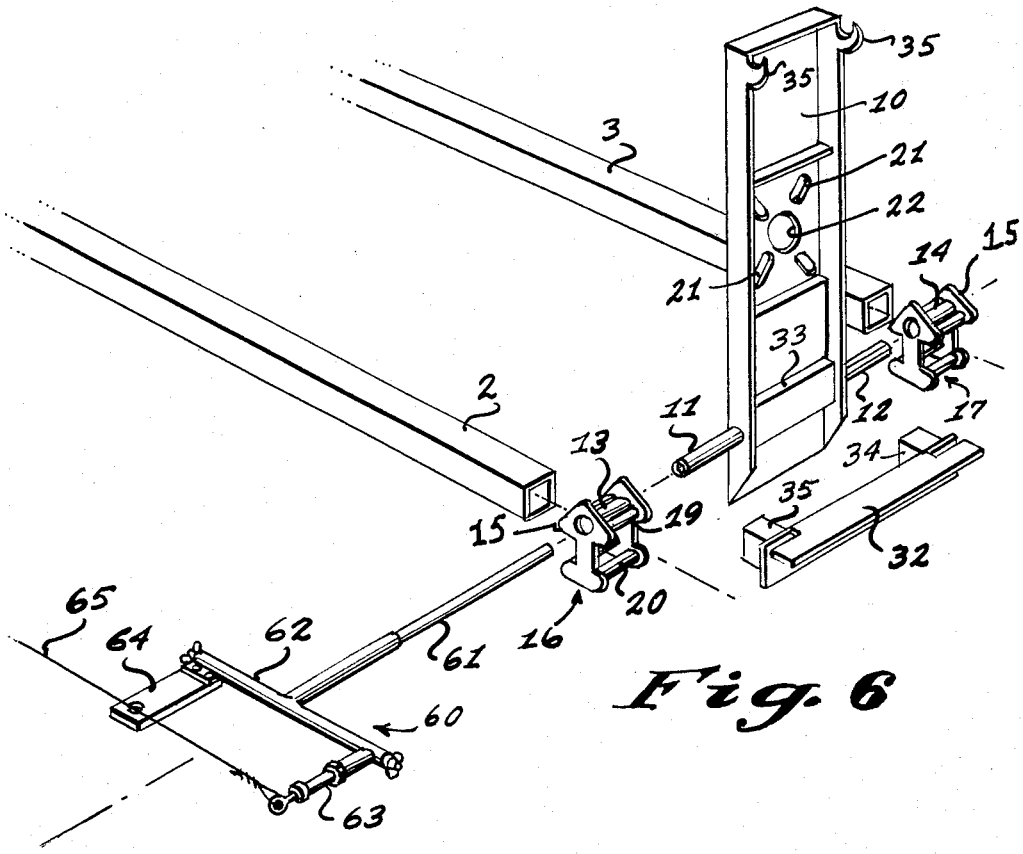
FIG. 6 is an exploded prospective view of the wheel attachment plate, the parallel tracks and journals together with a portion of the toe in detector.

A hydraulic jack 30 is used to supply the force required in the straightening operation, together with a chain 31. The chain and jack may be configured in a variety of ways, depending on the direction of force to be applied to the wheel. In order to anchor the chain and provide a platform for the jack there is provided a slotted flange 32 (See FIG. 6) to which is attached two sections 34 and 35 of tubular material which fit into the respective bores of each of the tubular members 2 and 3 so as to support the flange 32.

If it is desired to apply pressure to the top of the wheel, as shown by the arrow A in FIG. 7, then the jack is positioned in a straight line between the top flange of the plate 10 and the platform formed by the frame flange 32. The chain 31 is wrapped around the back of the plate 10 and its loose ends are secured in the slots in the flange 32 in order to prevent movement by the bottom of the plate 10 along the length of the tubular members 2 and 3 when force F is applied to the top of the plate 10 by the jack 30. It is seen that application of force in this manner by the jack will realign the wheel 5 from its cambered and overhung position shown in FIG. 7.

In cases where the wheel 5 is negatively cambered so as to lean inwardly, as shown in FIG. 8, the jack and chain are rearranged to produce a force which will rotate the plate 10 in the direction of arrow B. The base of the jack 30 takes its bearing on a rigid ledge 33 in the lower extremity of the plate 10 while the piston end of the jack engages the central portion of the length of chain 31 whose free ends are anchored in the slots of the base flange 32 and secured by hooks 35 integral with the top end of the plate 10 respectively. When force F is applied by the jack 30 tension is created in the chain and the top end of the plate is rotated according to the arrow B thus straightening the wheel to a desired vertical position.

To correct abnormal toe in and toe out a similar force arrangement is created on the wheel by the plate 10 with the use of the same hydraulic jack 30 and length of chain 31, bearing on and attached to a plate bracket 40 and a slidable anchor platform 42.

The bracket 40 comprises a length of square tubing having a flange engaging hook 43 attached to one side for grasping the flange of the plate 10 to maintain the bracket flush against the face of the plate when the jack 30 is exerting force F against the other end of the bracket, as shown in FIG. 3. One end of the bracket 40 is equipped with a slotted hook 44 to engage and hold the links of the chain 31, while the other end of the bracket serves to mount a pivotable socket 45 which engages a nipple on the end of the hydraulic jack.

The end of the chain which is not attached to the hook 44 is attached by a pin 46 to the sliding platform 42 establishing stretch of chain between the side of the plate and the center of the movable platform. The end of the hydraulic piston is equipped with a fork 47 to engage a link of the chain and provide a bearing for the force application of the jack. The straightening application shown in FIG. 3 is one where the toe in is excessive and the plate must be pushed by the jack in the direction of arrow C. As the force F is applied by the Jack 30 the Plate 10 tends to rotate about a vertical axis through the plate which would normally tend to slacken the chain 31 but for the fact that the bearing platform 42 is slidable along the slot 47 to keep the chain taut as the jack exerts the force. The slot 47, as seen in FIGS. 3 and 4 is disposed in a rigid plate 48 which could be welded or otherwise fastened to the fame members 2 and 3 but which, in the present embodiment is detachably secured thereto. The plate 48 overlays the frame member 2 and 3 and has downturned depending ends to which are attached tubes 50 and 51. A pin 54 is inserted in each of the tubes to maintain the plate 48 attached to the frame.

It is apparent that if the problem with the wheel is excessive toe out the bracket 40 is reversed and its hook 43 positioned to grasp the flange on the opposite side of the plate 10. The jack 30 is likewise repositioned to exert force on the back side of the bracket to produce rotation of the plate 10 in the direction of the arrow D in FIG. 3.

Another of the novel features of the structure of the present invention is the simplified toe in detector, generally indicated by reference numeral 60. The detector comprises a rod 61 which is inserted into the bore of the plate spindles 11 and which insures that the rod will be parallel to the plane of the wheel 5. A T-bar 62 attached to the outer end of the rod supports an adjustable length line holder 63 on one of its ends and a sighting target 64 on its other end. A line or cable 65 is strung from the holder 63 to a predetermined point at the other end of the straightening frame so that when the wheel is normal the line will be parallel to the frame members 2 and 3. If the wheel which is bolted to the plate 10 is toed in or out the rod 61 will not be perpendicular to the frame members 2 and 3 and the line 65 will not be parallel to the frame members and will not cross over the center of the sighting target 64. When the wheel has been correctly repositioned by the operation of the straightening device the line 65 will lie over the center of the target.

I claim:

1. A vehicle wheel alignment device comprising in combination:

a rigid frame having a pair of mutually parallel track forming members which frame is arranged to be disposed parallel to the axle of a vehicle wheel;

an upstanding wheel plate having apertures for receiving the lug nuts of a wheel and having bi-laterally projecting spindles attached to the lower portion thereof;

journal means carried by each of said tracks and movable therealong, rotatably mounting the respective spindle projections of the wheel plate; and power means bearing against the wheel plate to interchangeably pivot the plate about the axis formed by the projecting spindles and about the vertical longitudinal axis of the plate.

2. The combination of claim 1 and including chain means interconnecting the plate and the frame.

3. The combination of claim 2 wherein the power means is telescopically expansible and is disposed between the lower portion of the plate and the intermediate portions of the chain means.

4. The combination of claim 2 wherein the power means is telescopically expansible and is disposed between the upper portion of the plate and the frame.

5. The combination of claim 2 wherein the power means is telescopically expansible and forms one side of a triangular interconnection where the plate and chain form the other two sides.

6. The combination of claim 5 where the frame includes a slidable attachment for the apex of the triangular interconnection at the point between the chain means and the power means.

7. The combination of claim 1 and further including alignment gauge means interconnected between the plate and the frame and responsive to the change of angle between the plane of the plate and the plane of the frame.

* * * * *